US005355967A

United States Patent [19]

Mueller et al.

[11] Patent Number: 5,355,967

[45] Date of Patent: Oct. 18, 1994

[54] UNDERBALANCE JET PUMP DRILLING METHOD

[75] Inventors: Mark D. Mueller, Bakersfield; William O. Jacobson, San Diego, both of Calif.

[73] Assignee: Union Oil Company of California, Los Angeles, Calif.

[21] Appl. No.: 969,018

[22] Filed: Oct. 30, 1992

[51] Int. Cl.[5] ..... E21B 10/60

[52] U.S. Cl. ..... 175/65; 175/339; 175/393

[58] Field of Search ..... 175/393, 339, 65

[56] References Cited

U.S. PATENT DOCUMENTS

| | | | |
|---|---|---|---|
| 2,849,214 | 8/1958 | Hall | 175/339 X |
| 3,455,402 | 7/1969 | Tiraspolsky | 175/393 X |
| 4,083,417 | 4/1978 | Arnold | 175/393 |
| 4,475,603 | 10/1984 | Hayatdavoudi | 175/65 |
| 4,605,069 | 8/1986 | McClaflin et al. | 166/310 |
| 4,624,327 | 11/1986 | Reichman | 175/67 |
| 4,765,416 | 8/1988 | Bjerking et al. | 175/393 X |
| 4,809,791 | 3/1989 | Hayatdavoudi | 175/206 X |

FOREIGN PATENT DOCUMENTS

| | | | |
|---|---|---|---|
| 802513 | 2/1981 | U.S.S.R. | 175/393 |
| 829858 | 5/1981 | U.S.S.R. | 175/393 |
| 866122 | 9/1981 | U.S.S.R. | 175/393 |
| 1585493 | 8/1990 | U.S.S.R. | 175/393 |

*Primary Examiner*—Hoang C. Dang

*Attorney, Agent, or Firm*—Gregory F. Wirzbicki; William O. Jacobson

[57] ABSTRACT

A method for rotary drilling and removing cuttings provides a underbalanced drilling fluid pressure at the drilling face but overbalanced pressure in the wellbore. The preferred method uses a rotary drill within a housing which also encloses a jet pump which draws and pressurizes the cuttings and drilling fluid, a separator of the cuttings and a portion of the pressurized drilling fluid, and a nozzles to supply separated and reduced pressure drilling fluid back to drilling face while the cuttings and remaining pressurized drilling fluid flows up towards the surface. The method avoids overpressure strengthening of the drill face and underpressure damage to the wellbore.

22 Claims, 3 Drawing Sheets

UNDERBALANCE JET PUMP DRILLING METHOD

FIELD OF THE INVENTION

This invention relates to drilling devices and processes. More specifically, the invention is concerned with the control of fluid pressure within a wellbore while drilling.

BACKGROUND OF THE INVENTION

When rotary drilling an underground wellbore from the surface, a drilling fluid in the wellbore is typically used to prevent wellbore wall caving and prevent the intrusion of formation fluid, such as unwanted oil, gas, and water. Another important function of the drilling fluid (typically a "drilling mud" mixture) is to entrain drilled cuttings and circulate them to the surface and out of the borehole. The drilling fluid typically also cools and lubricates the moving drill string components and strikes the drilling face of the underground formation with an impact force that may further assist in drilling.

Although density, viscosity, and surface pressures on the drilling fluid are controlled, the density of the drilling fluid is the most important to control in order to provide a hydrostatic pressure in excess of formation pore pressure along the wellbore. This "overbalanced" pressure strengthens the wellbore (helping to avert wall cavings) and prevents a formation fluid influx or "kick" into the wellbore. However, the overbalanced pressure also strengthens the formation face being drilled similar to the strengthening of the walls of the drilled well. This now "harder" drilling face drills at a lower rate of penetration, increasing drilling time and cost.

Reducing the normally overbalanced pressure to minimize rotary drilling cost increases the risk of wellbore caving damage and well control problems. Thus, a drilling operator has to consider the conflicting fluid pressure needs of maintaining the integrity of the bore and economically drilling the formation face.

SUMMARY OF THE INVENTION

Such conflicting pressure needs are avoided in the present invention by controlling and isolating the pressure at the drill face from the pressure in the rest of the wellbore. This is accomplished by adding a jet pump to the drilling tool and a flow restricting housing to form an underbalanced pressure cavity at the drilling face. A first portion of the pressurized drilling fluid is introduced into the cavity and circulates to entrain cuttings at underbalanced pressure. The drilling fluid also serves as the power fluid of the jet pump which pressurizes the underbalance-pressure fluid and entrained cuttings back to the surface at overbalanced pressures. At the surface, the cuttings are separated (by conventional equipment such as shale shakers) and the drilling fluid is pressurized (typically by mud pumps) to be recycled back as the power fluid. The recycled drilling fluid can be introduced into the underbalanced pressure cavity formed by the housing as a plurality of streams for improved circulation, cooling, and lubrication.

One embodiment includes a cutting separator located in the jet pump housing near the jet pump diffuser outlet. A portion of the overbalanced-pressure fluid mixture continues to entrain the cuttings while a remaining portion (substantially free of cuttings) is diverted to the drilling face (and/or drill bit) within the cavity.

The invention uses the inherent fluid restriction of the drilling tool (including drill bit and shoe) combined with a housing which contains a jet pump. The housing and drilling tool restriction combined with the jet pump produce different (overbalanced and underbalanced) pressures above and below the drilling tool. The jet pump must not only handle the injected streams, but also fluid leakage past the around the drilling tool and any formation fluids produced across the drilling face. In addition to restricting or channeling flow, the shoe or outside lip of the drilling tool tends to support the wellbore at the overbalanced/underbalanced pressure transition zone.

The preferred process for drilling an underground borehole from a surface places the housed drilling tool and jet pump at or near the formation face to be drilled. Power fluid actuates the jet pump to maintain an underbalanced drilling fluid pressure while the drill bit is rotating and cutting into the formation face. The power fluid driven jet pump draws in the underbalanced-pressure drilling fluid and entrained cuttings mixture and discharges a majority of the mixture upwards towards the surface. A portion of the pump actuating fluid is diverted to supply drilling fluids to the rotary drill as jets to assist drilling and entrain cuttings.

BRIEF DESCRIPTION OF THE DRAWINGS

In these Figures, it is to be understood that like reference numerals refer to like elements or features.

DETAILED DESCRIPTION OF THE INVENTION

Figure 1:
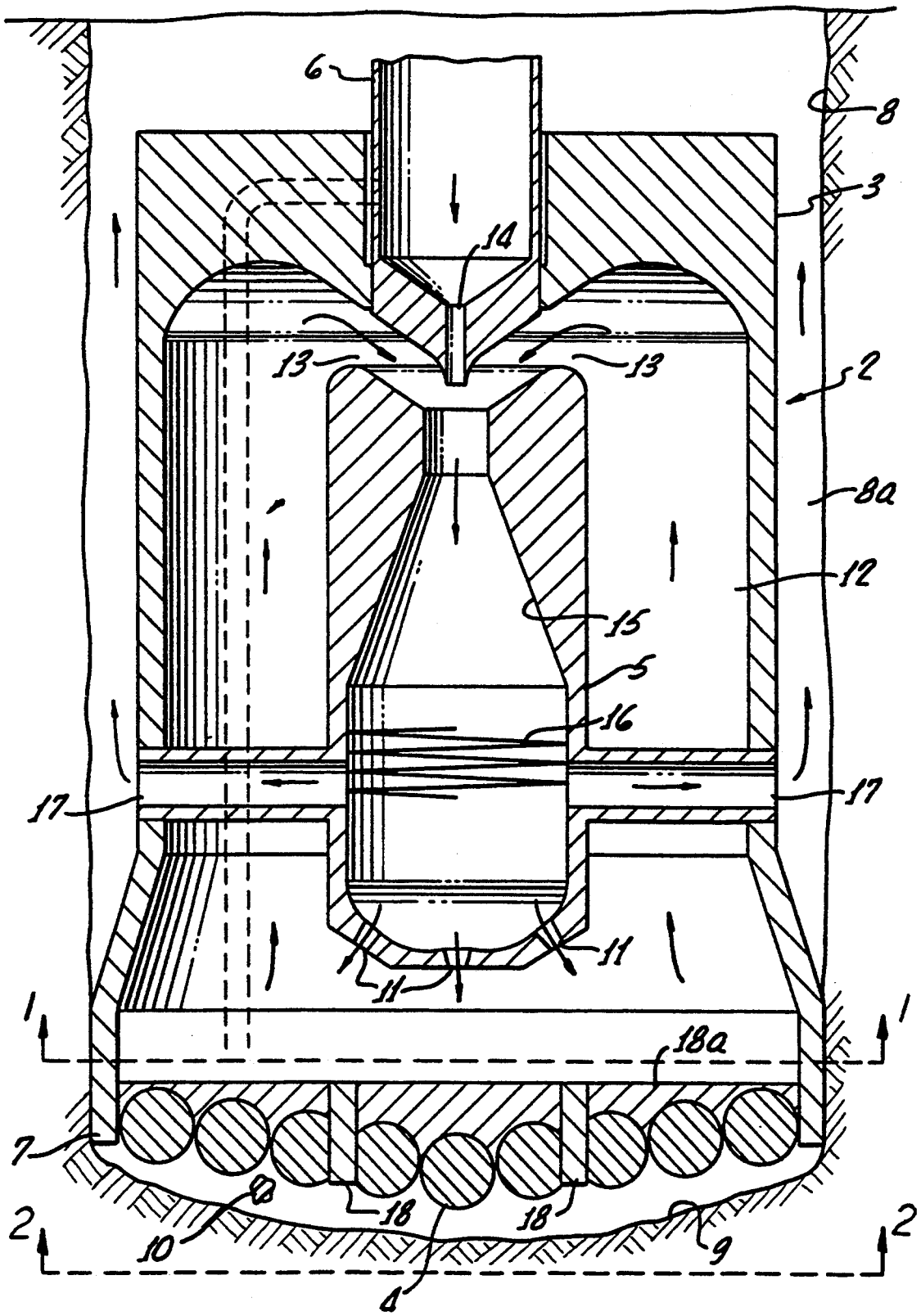
FIG. 1 shows a schematic cross-section of a rotary drilling tool and a jet pump housing.

FIG. 1 shows a schematic cross-section of a bottom hole assembly or rotary drilling tool 2 embodiment of the invention in an underground wellbore 8. A housing 3 partially covers a rotary drill bit 4 and a cavity 12 which nearly encloses a jet pump jacket 5. The housing 3 extends from a drill pipe connection 6 to a shoe or outer lip 7. The drill pipe connector 6 is typically threadably connected to a drill pipe or other fluid conductor extending up to-the surface (not shown). The outer diameter of the shoe 7 is typically proximate to or substantially in contact with wellbore 8 when drilling. The housing 3 (and reinforcing ring 18) supports the drill bit 4 and jet pump jacket 5 within the drilling tool 2, and forms an inverted cup-like enclosure of the drilling face 9.

The formation at the drilling face 9 is typically cut into by forcing (typically by a weight on bit) the drill bit against the drilling face 9 and rotating the attached drill pipe from the surface. The drill pipe rotation rotates the drilling tool 2 through attached connector 6 and housing 3. Alternatively, the rotation of the drilling tool 2 can be accomplished by means of a downhole mud motor. The rotation of the drill bit 4 (supported by substrate **18*a*) within the housing 3 (and reinforced by ring 18) cuts into or abrades the underground formation at drilling face 9. Cuttings, as illustrated by one particle 10 shown in FIG. 1 near the drilling face, are generated by the rotating drill bit 4** and must be carried out of the wellbore to the surface if the drilling is to continue.

Drilling fluid is supplied from nozzles 11 in the jet pump jacket 5 (fluid flow is shown in FIG. 1 by arrows) to the drill bit 4 and drilling face 9. The drilling jets of fluid emanating from the nozzles 11 can be directed to lubricate and cool the drill bit 4 as well as provide sufficient flow to the drilling face 9 to entrain cuttings 10. Although the number of nozzles 11 is theoretically infinitely variable, for a nominal "shoe" and housing outside diameter of 8½ inches (21.59 cm), the number of nozzles 11 is expected to range from no less than about 1 to no more than about 27, more typically ranging from about 3 to 5. Typical nozzle 11 shape is essentially a constant diameter hole or orifice, but contracting and/or expanding nozzle shapes (from a minimum throat dimension) are also possible. Typical orifice or minimum nozzle diameters for a nominal housing outside diameter of 8½ inches (21.59 cm) having 3 nozzles 11 in jet pump jacket 5 may range from as small as about 1/32 inch (0.0794 cm) to as large as about ½ inch (1.27 cm), but diameters are more typically expected to range from about 1/16 to 3/16 inch (0.159 to 0.476 cm).

Figure 2:
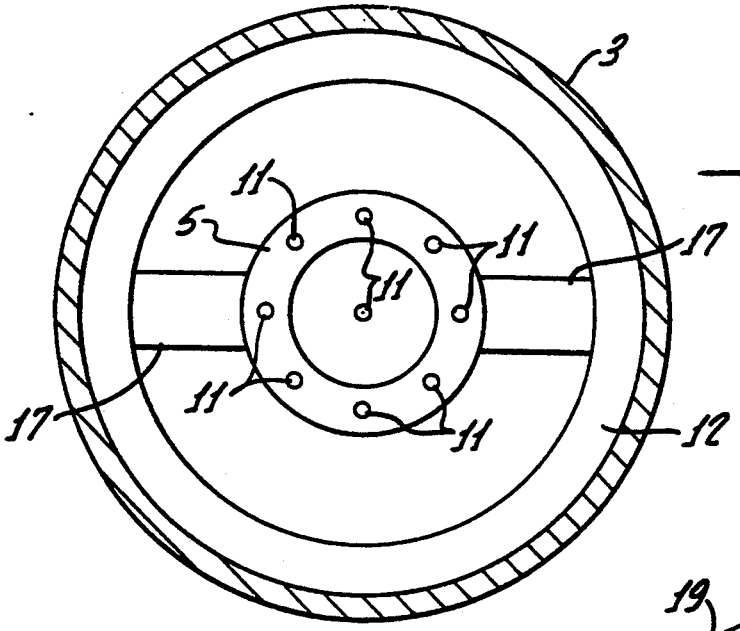
FIG. 2 shows sectional with 1—1, as shown in FIG. 1.
Figure 3:
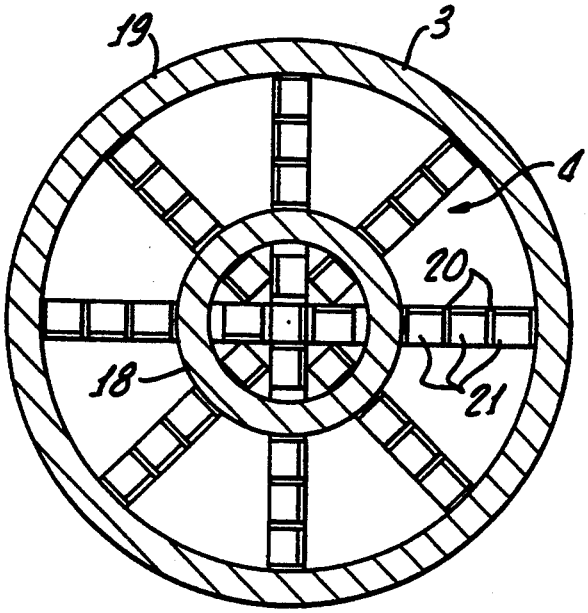
FIG. 3 shows sectional view 2—2 as shown in FIG. 1.

Each nozzle 11 is sized to produce a drilling jet in the fluid-filled cavity 12 which will impact a target. The target may be a portion of the drill bit 4 (e.g., for cooling and/or lubrication) or a portion of the drilling face 9, e.g., directed between drill bit elements (as shown in FIGS. 2 and 3) to entrain cuttings. If the target is a portion of the drill bit, the nozzle stream may also be required to carry past the drill bit 4 and onto the drilling face 9 to serve multiple purposes.

The number and size of nozzles 11, when combined with the pressure performance of the jet pump within jacket 5 and other sources of fluid into the cavity 12, produce a sufficient number of jet streams to create a flow of drilling fluid to entrain drilling cuttings 10. This flowrate is expected to be comparable to the circulation rate for comparable drilling tool diameters less an amount similar to the leakage flow (around the outside diameter) and formation fluid influx (at the drilling face).

The total fluid flow through nozzles 11, plus any influx of formation fluids at drilling face 9, cuttings, and leakage of fluid between the housing 3 and wellbore 8, forms a post-drilling fluid stream (at underbalanced pressure) which is drawn to suction ports 13 of the jet pump. The underbalanced-pressure stream flow is shown by generally upward pointing arrows in cavity 12 until suction ports 13 are reached. The nozzles 11 must also be sized to produce drilling jets which will overcome the underbalanced-pressure stream flow and reach the targets of the drilling jets.

The underbalanced-pressure stream must have a sufficient flowrate and velocity to entrain cuttings 10 and lift them to a suction port 13. For a nominal 8½ inch (21.59 cm) outside diameter drill tool, upward fluid velocity in the cavity 12 is expected to range from about 80 to 300 feet/sec (24.38 to 91.44 meters/sec), preferably no less than about 120 feet/sec (36.58 meters/sec).

The desired (underbalanced) pressure in cavity 12 and at the drilling face 9 is a function of the formation pore pressure at the drilling face. The underbalanced pressure in cavity 12 depends upon several other factors, including jet pump performance, power fluid pressure in drill pipe connector 6, and the cutting speed (i.e., the volume of cuttings 10 generated). Cutting speed and source fluid pressure are typically controlled by a drilling operator to attain the desired underbalanced pressure.

The underbalanced pressure in cavity 12 allows drilling to proceed economically. Pressure near the drilling face 9 is generally expected to be at least about 30 psi (2.0 atmospheres) less than the formation pore pressure at drilling face 9, more typically ranging from 100 to 1000 psi (6.8 to 68 atmospheres) less than the formation pore pressure at drilling face 9. At times, the average pressure in cavity 12 may be more than formation pore pressure (e.g., during transients or drilling into highly fractured formations), but an underbalanced pressure is expected to assist in economic rotary drilling most formations and therefore be underbalanced most of the time during drilling.

Once the upward flowing underbalanced-pressure stream (with entrained cuttings) in cavity 12 reaches the suction throats of ports 13 within housing 3, the stream is induced into the jet pump jacket 5. The energy to increase the pressure of the underbalance pressure stream is supplied by a power fluid flowing from the surface through the drill pipe and drill pipe connector 6 to jet pump nozzle 14. The jet pump nozzle 14 size and power fluid flowrate and pressure are selected to produce a high speed, venturi-like low pressure zone extending across the suction ports 13. This low pressure zone induces and accelerates the flow of underbalanced fluid and cuttings along with the high speed power fluid from jet pump nozzle 14 prior to entry into the diffuser section 15 housed in jacket 5.

Although a single jet pump nozzle 14 is shown directed into the diffuser cavity 15, a plurality of jet pump nozzles 14 may be also used. Some of the nozzles may be used to help divert or otherwise protect the diffuser throat from the erosive effects of the accelerated cuttings. The diffuser throat may also be composed of hard or hardened materials, such as tungsten carbide, to further resist erosion.

The high speed mixed power fluid and induced flows (including cuttings) enter a diffuser cavity 15 to convert the kinetic energy into increase pressure. The downwardly enlarging cross-sectional area of the diffuser cavity 15 slows the mixed power fluid speed and induced (fluid and cuttings) flows and increases the pressure (to an overbalanced pressure). This increased or overbalance pressure in diffuser cavity 15 is again controlled by the drilling operator primarily by the selection of power fluid pressure and flows at the surface. Although the overbalanced pressure can theoretically vary over a much wider range, the overbalanced pressure in diffuser cavity 15 is typically at least 100 psi (6.8 atmospheres) above formation pore pressure at drilling face 9, more typically ranging from about 200 to 500 psi (13.6 to 34.0 atmospheres) above formation pore pressure at drilling face 9.

After slowing in the diffuser cavity 15, the overbalanced pressure fluid then encounters a partial cuttings separator 16. In this embodiment, the separator 16 is a fixed, helically-shaped baffle swirling the mixed fluid and cuttings stream around the centerline of the drilling tool 2. The density differences between the swirling cuttings 10 and the swirling mixed fluids in separator 16 force the normally heavier cuttings outward towards discharge ports 17 along with a portion of the fluid flow. However, a portion of the (lighter-than-drill-cuttings) fluid stream separates from the entrained cuttings (nearer the centerline of the diffuser) to become the source for the drilling jet streams from nozzles 11.

The overbalanced-pressure, entrained mixture discharged from discharge ports 17 then flows up the wellbore 8 in the annulus between the walls of the wellbore 8 and the drill pipe towards the surface (not shown), as shown by generally upward pointing arrows proximate to the walls of wellbore 8. The overbalanced pressure in the wellbore 8 substantially prevents the influx of formation fluids into the wellbore (except proximate to the drilling face) as the fluid rises to the surface. For a typical discharge stream in the wellbore 8, a minimum fluid velocity of 80 ft/sec (24.38 meters/-sec) is expected, preferably at least 120 ft/sec (36.58 meters/sec).

At the surface, the mixed discharge stream is recycled. The entrained cuttings in the mixed stream are substantially fully separated by conventional means, such as cyclones, shakers, screens, and/or a setting basin (not shown). The cuttings-removed stream is then recycled by treating as necessary, pressurizing the stream in a conventional mud pump at the surface (not shown), and returning the pressurized stream downhole through the drill pipe as the power fluid supplied to the drill pipe connector 6. Treating can include further fluid monitoring and processing at the surface, such as monitoring density and adding muds to compensate for any influx of unwanted formation fluids.

The power fluid is expected to be a drilling mud entrained in water or other fluids, similar to other drilling fluids since the power fluid must also function as a drilling fluid as well as the means for operating the jet pump. This added jet pump requirement can require slightly different properties than that required for a drilling fluid only application. For example, the power fluid viscosity is expected to be slightly less than a similar drilling-fluid-only application.

Other possible uses for the power fluid/drilling fluid mixture emanating as a drilling jet stream from nozzles 11 include cooling and lubricating the drill bit 4. Drill bit 4 is shown schematically in FIGS. 1 and 3 as a segmented face type, e.g, diamonds or other hard inserts embedded in a segmented substrate. These types of drill bits are expected to require minimal lubrication and cooling other than that supplied by leakage around the shoe and formation fluids influx at the drilling face 9. But other types of drill bits can also be used which may require greater attention to separate jet streams for cooling and/or lubrication. This includes conventional cone-type rolling cutter bits which may require greater lubrication, but less cooling. (See FIG. 4.)

In addition to any cooling and lubrication provided by the drilling jet streams from nozzles 11 shown in FIG. 1, entrainment, lubrication and cooling flows to the drill bit 4 (and formation face 9) may also be provided by a conduit or passageway from the drill pipe connector 6 through housing 3 to near the drill bit 4 (shown dotted as an option for clarity). A separate fluid source instead of the power fluid may also be provided, such as lubricating fluid string. The conduits or passageways would transmit the power (or other) fluid to the drill bit, such as a roller axis, or impinge the drilling face 9. The separate conduit could further supplement or replace the cooling and lubrication provided by the drilling jet streams from nozzles 11. If the conduit replaces the nozzles 11, the separator 16 could be eliminated.

Instead of leakage, channels in the outside diameter of the shoe of housing 3 (not shown) are another alternative that can provide additional or bypass flows of entrainment, lubrication, and/or cooling fluids to near the drill bit 4. Increased amounts of fluid would flow through the channels from the overbalanced pressure wellbore 8 to the underbalanced pressure cavity. Although cuttings and sediment may tend to accumulate at this lowest point of the overbalanced-pressure wellbore cavity, the rotation of the housing 3 and the continuous jet pump suction is expected to keep these channels free flowing.

FIG. 2 is the sectioned view 1—1, as shown on FIG. 1. Eight drill stream nozzles 11 around a central nozzle 11 are shown in diffuser jacket 5, but other nozzle numbers and geometries are possible.

The preferred drilling jet stream nozzles 11 not only direct the jet streams downward and outward (as shown in FIG. 1), but circumferentially as shown by the arrows in FIG. 2 emanating from the nozzles 11. This circumferential component of the jet stream directs the drilling jet streams onto the side of a segment of drill bit 4 and (from there) onto the drill face 9 (also see FIGS. 1 and 3). Other configurations can have some of the drilling jet streams from nozzles 11 directed between the drill bit segments (see FIG. 3) to directly impinge the drill face (see FIG. 1).

In addition to providing discharge conduits through the cavity 12 to the outer annulus **8*a* between the upper portion of the housing 3 and the wellbore 8 (see FIG. 1), the discharge ports 17 shown on FIG. 2 further serve to laterally support and stabilize the jet pump jacket 5 with respect to the drill tool housing 3. If additional lateral and/or axial support of the jacket 5 is needed, jacket-to-housing struts (not shown) or added discharge ports 17** approximately 90 degrees from those shown may be provided.

FIG. 3 is the sectioned view 2—2, as shown on FIG. 1. Eight radial or spoke-like drill bit segments 19 (only one identified for clarity) of drill bit 4 are spaced around the cutting face enclosed by housing 3. In addition to the structural rigidity provided by housing 3 and the radially oriented substrates **18*a* (see FIG. 1) which form the drill bit segments 19 shown in FIG. 3, the inner ring 18 reinforces the drill bit segments 19 and provides additional strength. Depending upon contact and pressures between the lip 7 of housing 3 (see FIG. 1**), the reinforced housing also stress relieves the formation just above the drilling face.

The inner ring 18 may also tend to segregate drilling fluid circulation patterns as shown by the arcuate arrow near the drilling face 9 as shown on FIG. 1. The segregated circulation patterns can prevent hot spots and/or areas where cuttings are not fully entrained.

Within the spoke-like drill bit segments 19 in FIG. 3 are channel spaces 20 for fluid flow. The channels 20 (in the substrate **18*a* as shown in FIG. 1) shown in FIG. 3 are provided between hardened cutting faces 21 to allow cuttings and fluid flow across a drill bit segment 19 as well as around it. Cutting faces 21 are shown embedded in the substrate 18*a* or otherwise fixed in position relative to the housing 3, but cutting faces 21 may also be rotatable around an axis parallel or nearly parallel to the length of the drill bit segment 19** they are mounted on.

Figure 4:
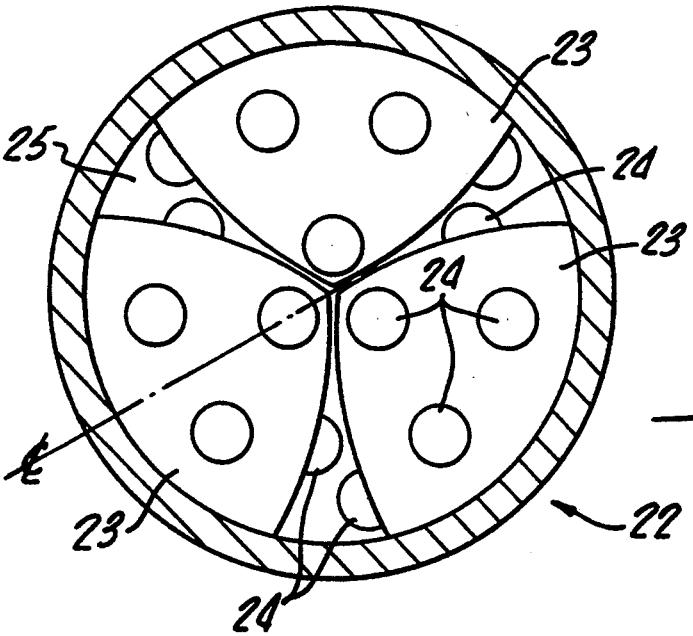
FIG. 4 shows alternative drill bit as viewed as a sectional from line 2—2, as shown in FIG. 1.

FIG. 4 shows an alternative roller drill bit 22 as it would be viewed at Section 2—2, as shown in FIG. 1, similar to the view of drill bit 4 shown in FIG. 3. Each of the three roller cones 23 shown in FIG. 4 has alternative hardened cutting protrusions 24 (identified only on one roller cone for clarity) embedded in a roller cone substrate.

The roller cones 23 rotate around individual centerline axis (only one shown for clarity) which is typically doubly offset. It is offset slightly from the (housing) radial direction and slightly out a plane parallel to section 2—2, (as shown in FIG. 1). The slight centerline offsets produce a scraping action as the roller cones 23 rotate as the entire roller drill bit 22 rotates, facilitating the cutting action. The roller cones 23 can be freely rotating as shown, geared to rotate together, driven to rotate (for example by a mud motor), or assisted in rotating by an offset impingement of a drilling jet stream.

Drilling jet streams from nozzles 11 (see FIGS. 1 and 2) could directly or offset impinge on the roller cones 23 shown in FIG. 4, but could also be directed towards the drilling face 9 (see FIG. 1) between the roller cones in spaces 25. The drilling fluid mixture and entrained cuttings would return through the spaces 25 to a cavity similar to cavity 12 shown in FIG. 1 and be drawn into a jet pump as previously discussed.

Figure 5:
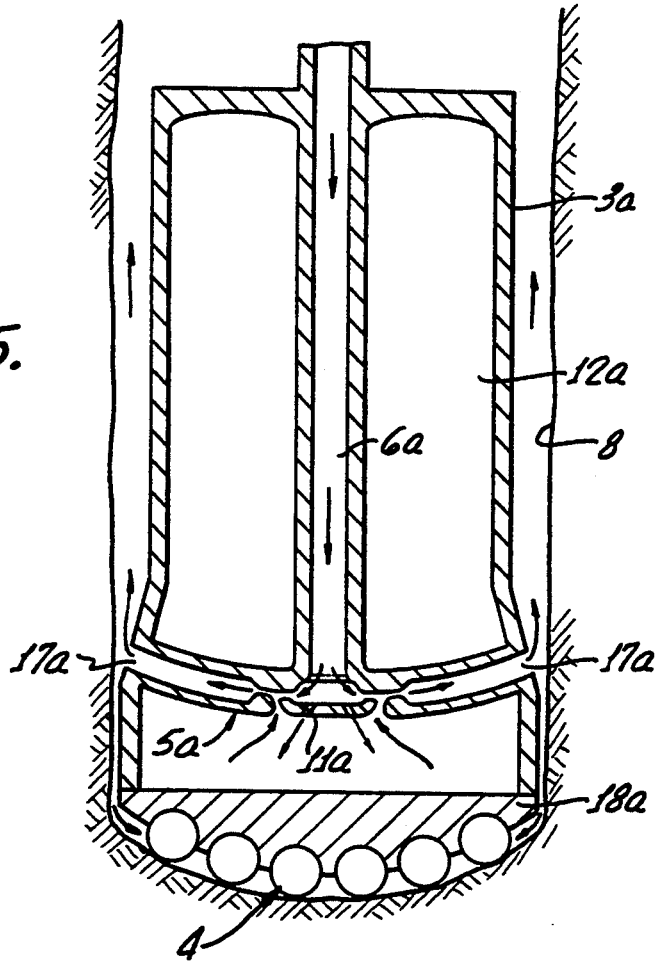
FIG. 5 shows an alternative jet pump embodiment.

FIG. 5 is a cross-sectional schematic of an alternative and preferred embodiment which deletes the need for the partial downhole separator 16 (shown in FIG. 1). A power fluid (typically pressurized using a surface mounted pump in conjunction with the hydraulic head developed at the underground location), similar to that previously discussed, is conducted down an alternative drill pipe or other conduit connector 6*a*. Portions of the power fluid (shown as arrows) exit as alternative drilling jet streams through alternative drilling jet nozzles 11*a* and the remainder serves as to actuate the alternative jet pumps 5*a*. The drilling fluid and entrained cuttings in alternative cavity 12*a* (with flow shown as arrows) are drawn into alternative suction ports (similar to ports 13 shown in FIG. 1) to be increased to overbalanced pressure and directed back towards the surface through the annulus proximate to the wellbore 8. It will be understood by those skilled in the art that still other alternative suction ports locations and drilling jet nozzle configurations and orientations can be made, e.g., when improved erosion resistance or proximity of the suction ports to the drilling face is required.

The alternative discharge parts 17*a* are shown arched to discharge in a slightly upward direction toward the surface proximate to where they are attached to the alternative housing 3*a*, but many other directions are also possible. The arced embodiment tends to throw cutting to the outside surface of the arc, allowing take-off (not shown) of relatively cuttings-free fluids from the inside surface of the arc, if required. Alternative discharge ports 17*a* may be nearly straight and oriented in a nearly vertical direction (discharging fluid near the top of the alternative housing 3*a*) or further curved to form a nearly 90 degree turn from a nearly horizontal orientation near the alternative suction ports (similar to ports 13 shown in FIG. 1) to discharge into annulus 8*a* near the alternative housing 3*a*. Still further, the structure forming the alternative discharge ports 17*a* can also be part of the drill bit substrate 18*a*, supporting the combined functions of the jet pumping and rotary drilling.

Figure 6:
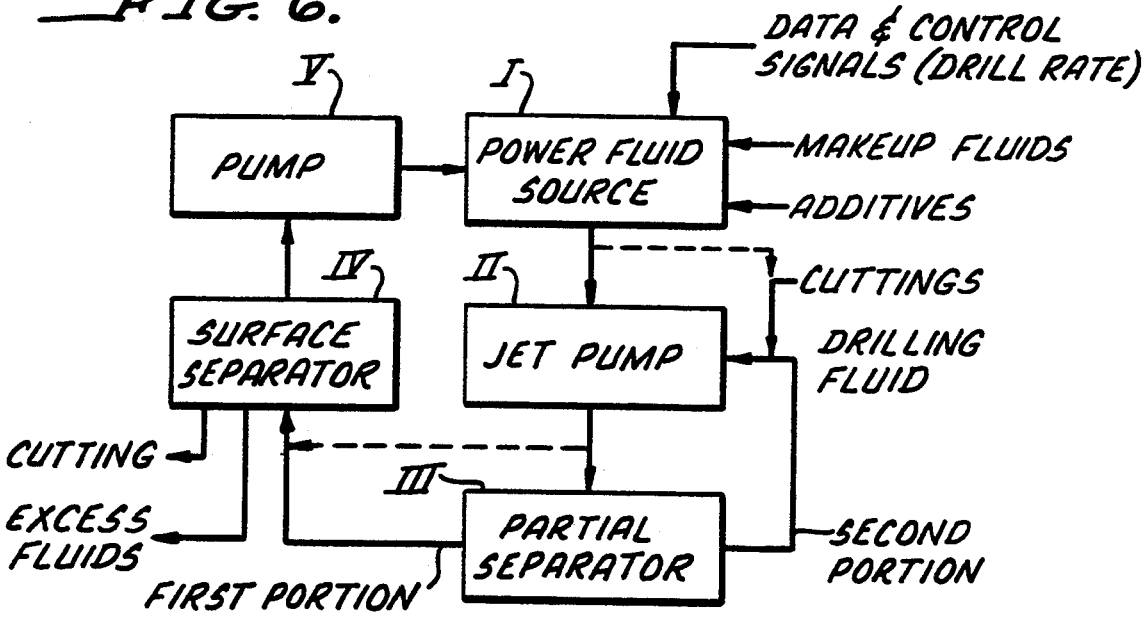
FIG. 6 shows a process flow schematic.

FIG. 6 shows a process flow schematic. A recycled source of fluid at the surface (from pump V) supplies power fluid source I, along with additives, makeup fluids, data, and controls as required. Controls may be operated manually by a drilling rig operator or may be computer controlled by a programmable controller to which data signals, such as rotational speed, are transmitted. The power fluid source I is typically mounted at the surface near the wellbore being drilled.

The pressurized (and controlled flowrate of) power fluid is transmitted downhole, typically via rotating drill pipe, to a jet pump II, such as that shown in FIG. 1. The jet pump II creates a suction which draws in drilling fluids and entrained cuttings from the drilling face.

The mixture of power fluid, drilling fluid, and entrained cuttings is discharged to a partial separator III in the preferred embodiment. The partial separator III concentrates the cuttings in a first portion of the power fluid and drilling fluid mixture, which is directed back up towards the surface to a surface separator IV. The remaining second portion can form a primary source of the drilling fluid, which is throttled to a lower pressure, sprayed towards the formation face being drilled, and drawn back into the jet pump II (possibly along with formation fluids and leakage and/or channeled bypass flows as previously discussed).

The surface separator IV removes most of the cuttings, along with some (excess) fluids, producing a fluid relatively free of large cut particles. The fluid is then directed to a pump V where it is recycled back to the power fluid source I for treatment and/or controls. Alternatively, the locations of pump V and power fluid source I can be interchanged.

The process of using the alternative embodiment shown in FIG. 5 is the same as shown in FIG. 6 except the first and second portions are produced at the jet pump II intake, shown as a dotted line. This allows the elimination or bypassing of the partial separator III.

Still other alternative embodiments are possible. These include: a variable throat jet pump nozzle 14, e.g., a moveable conical plug place at the throat of the jet pump nozzle; a variable diffuser throat, e.g. a moveable throat to allow for erosion; a plurality of jet pumps, at least one of which does not supply drilling jet nozzles and at least one which does; and inverting the orientation of the jet pump within the jacket 5, placing the suction ports 13 closer to the drilling face 9.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A drilling apparatus for drilling an underground wellbore from a surface location which comprises:

a rotary drill capable of producing cuttings from an underground formation face;

a housing partially enclosing said rotary drill, said housing capable of restricting fluid flow between an upper portion and a lower portion when said rotary drill is drilling;

jet pump means located proximate to said housing and capable of inducing a mixture comprising a drilling fluid and said cuttings at a first pressure from said lower portion and discharging said mixture at a second pressure to said upper portion when said jet pump means is actuated by a power fluid and said rotary drill is rotated, wherein said jet pump directs said mixture in a direction not toward said underground formation face when said drill is producing said cuttings; and a source of a power fluid stream attached to said jet pump means.

2. A drilling apparatus for drilling an underground wellbore from a surface location which comprises:

a rotary drill capable of producing cuttings from an underground formation face;

a housing partially enclosing said rotary drill, said housing capable of restricting fluid flow between an upper portion and a lower portion when said rotary drill is drilling;

jet pump means located proximate to said housing and capable of inducing a mixture comprising a drilling fluid and said cuttings at a first pressure from said lower portion and discharging said mixture at a second pressure to said upper portion when said jet pump means is actuated by power fluid and said rotary drill is rotated;

a source of a power fluid stream attached to said jet pump means; and a partial separator for separating a majority of said cuttings from said power fluid after said power fluid stream actuates said jet pump, said partial separator located proximate to said housing.

3. The drilling apparatus of claim 2 wherein said partial separator produces a cuttings separated stream at least a portion of which is directed towards said formation face and wherein said source of power fluid comprises;

surface separator means for separating most of said cuttings from said mixture after reaching a location near the surface, leaving a surface separated fluid;

pump means for pressurizing said surface separated fluid and located near said surface separator means; and duct means for fluidly connecting said pump means to said housing.

4. The drilling apparatus of claim 3 wherein said rotary drill comprises a three roller cone drill bit.

5. The drilling apparatus of claim 4 wherein said housing substantial encloses said rotary drill on all sides except the side facing said formation face.

6. The drilling apparatus of claim 5 wherein said formation face is at a formation pressure and said jet pump means comprises a jet pump capable of producing a discharge fluid mixture at a discharge pressure greater than said formation pressure while drawing a fluid mixture from proximate to said formation face at an intake pressure less than said formation pressure.

7. The drilling apparatus of claim 6 wherein said jet pump discharge is split into a first portion and a second portion.

8. The drilling apparatus of claim 7 wherein said first portion is further discharged through a plurality of jet nozzles.

9. The drilling apparatus of claim 8 which comprises at least 5 nozzles.

10. The drilling apparatus of claim 9 wherein said nozzles each have a minimum cross-sectional dimension of 1/32 inch.

11. The drilling apparatus of claim 10 wherein at least one of said nozzles is oriented in a generally downward direction and has a radially outward and circumferential component.

12. The drilling apparatus of claim 11 wherein said discharge pressure is within the range of from about 30 to 1,000 psi greater than said formation pressure.

13. The drilling apparatus of claim 12 wherein said discharge pressure is at least 1000 psi greater than said formation pressure.

14. A drilling apparatus which comprises:

a drill capable of producing cuttings from an underground formation face in a cavity;

a housing attached to said drill, said housing capable of restricting fluid flow between a first portion of said cavity and a second portion of said cavity proximate to said formation face;

fluid pump means for removing said cuttings and a fluid mixture from said second portion at a first pressure and discharging said cuttings and said fluid mixture to said first portion at a second pressure which is greater than said first pressure, wherein said fluid pump means directs said mixture in a direction not towards said underground formation face when said drill is producing said cuttings; and a source of a power attached to said pump means.

15. The apparatus of claim 14 which also comprises a programmable controller for controlling the first and second pressures.

16. The apparatus of claim 15 which also comprises means for removing said cuttings from said first portion and out of said cavity along with said fluid mixture.

17. The apparatus of claim 16 which also comprises:

means for supplying said fluid mixture to said second portion;

means for obtaining data on the properties of said fluid mixture; and means for changing the properties of said fluid mixture.

18. A process for drilling an underground borehole from a location near a surface using a rotary drill at a formation face with a drilling fluid to produce cuttings at a formation face, said process comprising:

supplying a jet portion of a pressurized power fluid to a jet pump drawing on said drilling fluid and cuttings at an underbalanced pressure, pressurizing said cuttings and said drilling fluid to form a pressurized mixture at an overbalance pressure;

discharging a first portion of said pressurized mixture towards said surface;

supplying a drilling portion of said power fluid to a location proximate to said formation face when said location is at said underbalanced pressure; and downhole separating at least a portion of said pressurized drilling fluid and said power fluid from said cuttings to form said drilling portion.

19. The process of claim 18 wherein said underbalanced pressure ranges from about 100 to 1,000 psi less than the formation pressure at said formation face.

20. The process of claim 19 wherein said overbalanced pressure ranges from about 30 to 1,000 psi more than the formation pressure at said formation face.

21. The process of claim 20 wherein said discharging step produces a velocity of at least 80 feet/second.

22. A process for drilling a wellbore which comprises:

producing cuttings from a solid material;

pumping said cuttings entrained in entraining fluid located proximate to said material, forming a pumped mixture, said pumping being motivated by a power fluid stream;

separating at least a portion of said entraining fluid from said cuttings within said wellbore; and diverting a portion of said power fluid stream to a location proximate to said drill, forming at least part of said entraining fluid.

* * * * *